United States Patent [19]

Light

[11] 4,319,616

[45] Mar. 16, 1982

[54] GOLF CLUB CARRIER

[76] Inventor: Richard D. Light, 1500 E. 82nd St., Indianapolis, Ind. 46240

[21] Appl. No.: 174,810

[22] Filed: Aug. 4, 1980

[51] Int. Cl.[3] ..... A63B 55/02

[52] U.S. Cl. ..... 150/1.5 C

[58] Field of Search ..... 150/1.5 R, 1.5 B, 1.5 C

[56] References Cited

U.S. PATENT DOCUMENTS

| | | | |
|---|---|---|---|
| 2,568,810 | 9/1951 | Kish | 150/1.5 R |
| 2,760,782 | 8/1956 | Hartzell | 150/1.5 B X |
| 2,799,315 | 7/1957 | Strasburg | 150/1.5 R |
| 3,014,732 | 12/1961 | Schemenauer | 150/1.5 B X |
| 3,172,681 | 3/1965 | Moses . | |
| 3,373,911 | 3/1968 | Kebelbeck . | |
| 3,674,072 | 7/1972 | Shuto | 150/1.5 R |
| 3,729,036 | 4/1973 | McFadden | 150/1.5 R |
| 3,941,398 | 3/1976 | Nelson | 150/1.5 R X |
| 4,111,248 | 9/1978 | Leichhardt | 150/1.5 R |
| 4,136,724 | 1/1979 | Leitzel . | |
| 4,142,563 | 3/1979 | Ackerfeldt | 150/1.5 C |
| 4,245,684 | 1/1981 | Street | 150/1.5 B |

*Primary Examiner*—Donald F. Norton

*Attorney, Agent, or Firm*—Woodard, Weikart, Emhardt & Naughton

[57] ABSTRACT

A golf club carrier for carrying golf clubs and related equipment and accessory items includes a part-cylindrical inner member molded into two halves and securely joined together, an outer lip portion with a series of spaced club shaft-receiving apertures, a lower shelf portion supporting the grip ends of the clubs and a protective cover detachably secured between the outer lip portion and the lower shelf portion. The inner member includes a first curved surface and a second substantially flat enclosing surface. Disposed between these surfaces and comprising the interior of the inner member are two comparatively larger storage compartments and two comparatively smaller storage compartments, each having its own access panel. These compartments are used for storage of equipment and related golf accessory items and one of the two comparatively larger compartments is thermally insulated for retention of food and drink.

6 Claims, 5 Drawing Figures

GOLF CLUB CARRIER

BACKGROUND OF THE INVENTION

This invention relates in general to golf equipment and in particular to golf bags and similar golf club carriers.

Equipment for carrying golf clubs can generally be grouped into two categories. The first category includes open, wheeled carriers of a rectangular shape, often referred to as a "low-boy" carrier. The second category includes conventional golf bags. Carriers in the first category must be pulled on their wheels and cannot be carried over the shoulder of the golfer nor are they suitable for being loaded into an electric golf cart. The clubs are held in individual soft pouches which extend for only about one-third of the club length. A limited number of small storage pouches are provided as part of this carrier and a flat resting shelf is often included.

The carriers in the second category are clearly the most common, yet virtually all golf bags suffer from the same disadvantages of excessive size and weight. Further, the storage areas or pouches are poorly organized and located, especially with respect to how the bags must be positioned on golf carts. Most golfers compile a collection of tees, balls, pencils, old scorecards, gloves, insect repellant, ball markers, etc., which are randomly strewn throughout the storage pockets or pouches of the golf bag. If the storage areas are large enough (usually governed by the size of the bag), one often finds an old jacket or two, towels, and hats. The state of confusion which results should be apparent. When the golfer wishes to locate a specific item or article three or four different storage areas may need to be searched. This problem is compounded by the locations of these storage areas and their circumferential positioning around the exterior of the bag. If the bag is mounted onto a wheeled cart, certain storage areas may simply not be accessible without removal of the bag from the cart. Since the storage areas are usually soft pouches, the interior space may be compressed or contorted such that it is difficult to retrieve the contents. Another disadvantage commonly associated with conventional golf bags is that the interior space of the golf bag is excessive with respect to the space needs for the clubs which are carried therein and this represents another design inefficiency.

The first category of golf club carriers while not altogether suffering from all of the same above-identified disadvantages, are of a somewhat different style and should not be considered a golf bag in the general sense. These "low-boy" carriers do not provide any protection to the clubs from the elements, storage space is limited, durability is questionable, and transporting is awkward. These types of shortcomings have been recognized generally by golfers thereby accounting for the limited popularity of this first category type of carrier. Further, there is no attempt with carriers of either category to arrange the storage areas in a particular manner nor to reduce size and weight while retaining the desirable features of conventional golf bags.

The following listed patent references disclose golf bag concepts and golf equipment storage concepts, but none are anticipatory of the present invention:

| U.S. Pat. No. | Patentee | Issue Date |
|---|---|---|
| 3,172,681 | Moses | 3/09/65 |
| 3,373,911 | Kebelbeck | 3/19/68 |
| 3,674,072 | Shuto | 7/04/72 |
| 3,729,036 | McFadden | 4/24/73 |
| 3,941,398 | Nelson | 3/02/76 |
| 4,136,724 | Leitzel | 1/30/79 |
| 4,142,563 | Ackerfeldt et al. | 3/06/79 |

Moses discloses a golf club carrier in combination with a wheeled golf cart which includes a plurality of club-receiving tubes extending between a top plate and a bottom plate. The top plate is further configured with areas for storage of golf balls, tees, and scorecards and interior to the plurality of tubes is an accessory bag. Although this construction eliminates some of the excessive weight and size associated with conventional golf bags, nothing is done to simplify and make more efficient the storage of accessory golf items. Furthermore, this particular construction coincides more closely with the first category of carriers than the second category in that this construction should not be considered a golf bag which is of the type of construction to which the present invention pertains.

Kebelbeck discloses a receptacle which is adapted for attachment to a golf bag cart for the storage therein of street shoes or golf shoes as well as a removable waterproof cover for the golf bag itself. Although this particular disclosure pertains to a storage compartment for golf equipment, it does not represent a modification or change in design of golf club carriers and is believed to be of only limited applicability to the present invention.

Shuto discloses a sectional golf bag which can be manually assembled without sewing machines and related equipment. The construction concept involves force-fitting of certain component parts into the final configuration as well as the use of certain fastener elements to assist in the construction and assembly. Although the concepts represented by this reference may be novel, the end product is still a conventional golf bag in outward appearance and suffers from the same disadvantages previously discussed.

McFadden discloses an insertable liner for golf bags which consists of a rectangular sheet of material which is flexible but self-supporting and which is rolled to form a tube of a predetermined diameter. This liner is adjustable in size to as to permit a selected annular space within the golf bag into which golf clubs can be placed. Although this construction improves the utilization of the interior space of a conventional golf bag, nothing has been done to improve the storage facilities for accessories and related golf equipment.

Nelson discloses a golf club holder which includes a plurality of elongate bores for receiving the shafts of golf clubs and although further novel features are discussed, there is no mention of improving on the present disadvantages of conventional golf bag storage pockets and pouches.

Leitzel discloses a golf club carrier similar in many respects to Nelson in that means are provided for keeping the clubheads separated from each other. Once again, however, no improvements have been made or suggested as to the storage compartments for equipment and golf accessory items.

Ackerfeldt et al. discloses a golf bag for storage and transport of golf clubs and includes a relatively long and narrow container preferably of a plastic material for receipt of the golf clubs such that with the shafts inserted, only the heads of the clubs protrude from the container at its upper open end. Separate storage bags are provided and are detachably mounted to the exterior surface of the container by means of two, parallel, external key grooves in the peripheral wall of the container.

It is to be pointed out that while each of the above patent references relate generally to conventional golf bags and modifications thereof, none of the disclosures anticipate the invention described herein.

SUMMARY OF THE INVENTION

A golf club carrier for transportation and carrying of golf clubs and for storage of equipment and golf accessories according to one embodiment of the present invention comprises an elongate inner member arranged into a plurality of rigid, separate compartments and golf club-receiving means disposed around and exterior to the elongate inner member for holding golf clubs in an accessible manner.

One object of the present invention is to provide an improved golf club carrier.

Related objects and advantages of the present invention will be apparent from the following description.

DESCRIPTION OF THE PREFERRED EMBODIMENT

Figure 1:
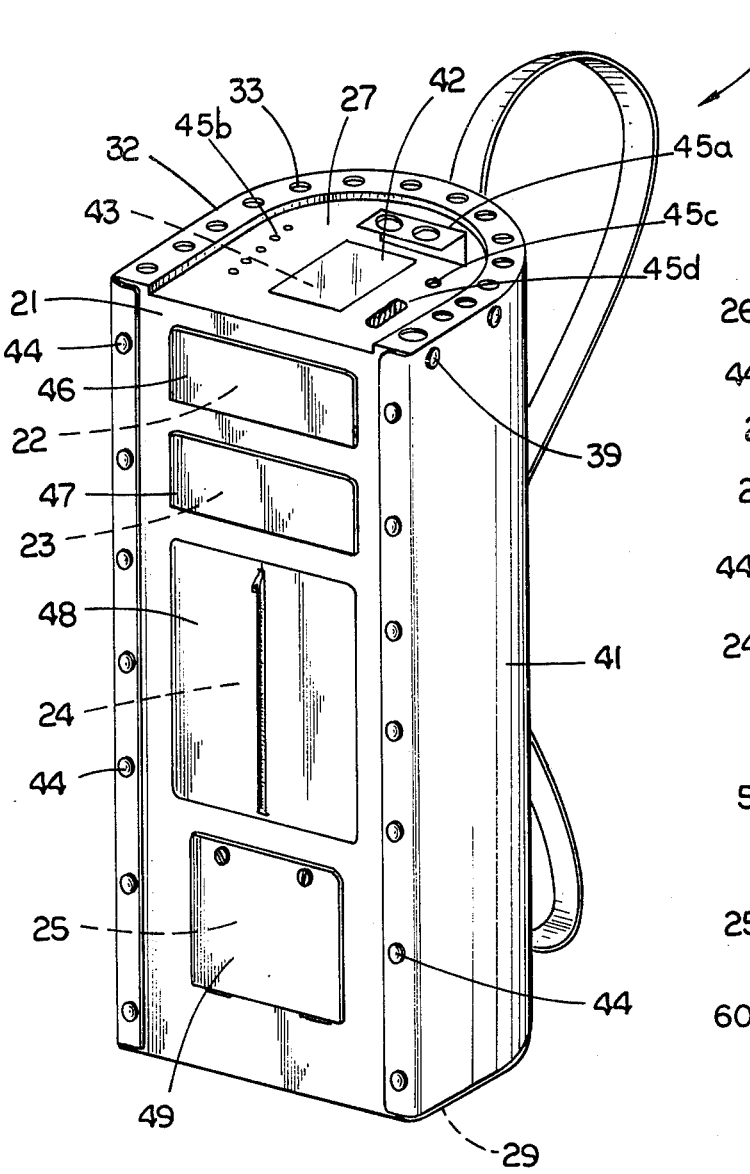
FIG. 1 is a perspective view of a golf club carrier according to a typical embodiment of the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 2:
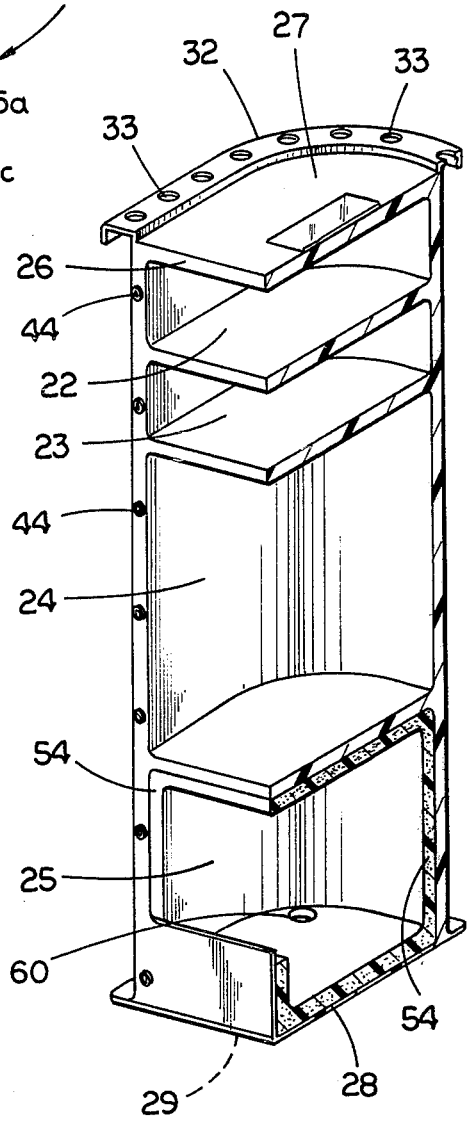
FIG. 2 is a perspective view of a full section of the FIG. 1 golf club carrier.

Referring to FIGS. 1 and 2, there is illustrated an improved golf club carrier 20 according to a typical embodiment of the present invention. Golf club carrier 20 includes a part-cylindrical inner member 21 which is arranged into a plurality of rigid, separate article-carrying storage compartments 22, 23, 24 and 25 in stacked relation to each other. Inner member 21 is configured with a curved outer surface completed by a substantially flat side wall. The lateral cross-sectional shape is generally semi-circular yet is truly D-shaped because the curved outer surface extends beyond the circular center and correspondingly, the side wall width is less than a full diameter.

Figure 3:
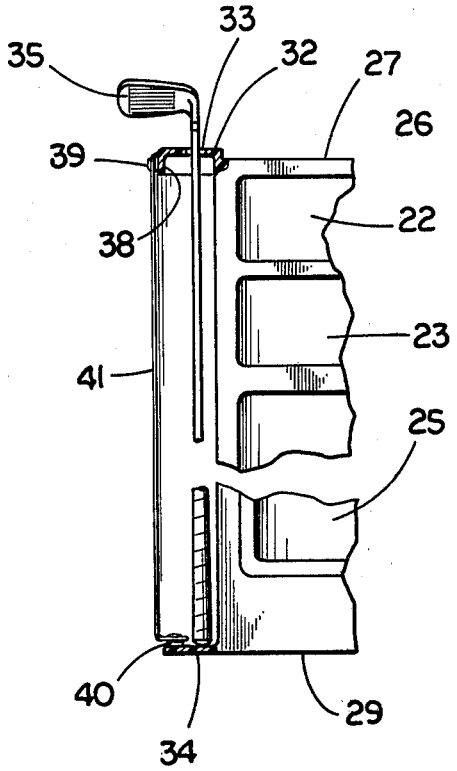
FIG. 3 is a partial front elevation view of the FIG. 1 golf club carrier with portions in section to show structural features.

Inner member 21 includes an upper panel portion 26 with a substantially flat top surface 27 and a lower panel portion 28 providing the lowermost surface 29 of the inner member. Surrounding the curved edge of top surface 27 is an outwardly extending lip 32 which includes a plurality of equally spaced club shaft-receiving apertures 33. Cooperatively aligned with lip 32 is a shelf portion 34 outwardly extending from the curved edge of surface 29. Golf clubs 35, only one of which is illustrated (see FIG. 3), are received and retained by the plurality of apertures 33. Since there is clearance between the aperture diameter and the club shaft outside diameter, shelf portion 34 controls the depth of position of the various golf clubs. As an added retention means, shelf portion 34 may be provided with slight depressions or indentations into which the end of the club shaft grip portion may be inserted.

Lip 32 includes a total of 14, same-sized apertures 33 for the golf clubs (the number 14 is equal to the legal number of clubs one may carry) and a 15th aperture at the end of the series of apertures which is of a larger size for a golf umbrella. Lip 32 includes a downwardly extending rim portion 38 which in the exemplary embodiment is fitted with one half of a first series of heavy-duty metal snap fasteners 39 circumferentially around its exterior. Shelf portion 34 is also provided with one half of a second series of heavy-duty metal, snap fasteners 40 equally spaced relative to the first series. A heavy vinyl protective cover 41 is provided with the cooperating halves for the first and second series of fasteners. Cover 41 provides protection while carrying or transporting the golf clubs as well as protection from the weather. Although cover 41 is adequately secured by the two series of metal snap fasteners, additional fasteners 44 are provided along the side edges of the flat side wall of inner member 21 adjacent the end edges of the curved outer surface. In lieu of metal snap fasteners, it is envisioned that any similar joining technique may be used such as synthetic, mutually-engaging loops and hooks, commonly referred to as "Velcro" fasteners.

Although not illustrated in the FIG. 1 embodiment, it is envisioned that stiffening ribs will be provided between the outer periphery of lip 32 and the outer periphery of shelf portion 34. These stiffening ribs are to be disposed between the golf clubs and cover 41 for providing a rigid support surface when the golf bag is loaded onto a pull cart or related conveyance.

Top surface 27 is substantially flat and includes centrally therein a clear, enclosed pouch 42 for a scorecard 43. This enables the card to be viewed as to current entries and is easily removable for updating. The flatness of surface 27 eases updating of the card and the enclosed nature of the pouch shields the card from wind and rain. It is also envisioned that the outer portion of surface 27 be marked with golf club identification designations for the clubs inserted into apertures 33.

Also disposed in top surface 27 are various receiving (holding) means for related golf accessories such as balls, tees, pencils, cigarettes, etc. Bracket 45*a* and apertures 45*b*–45*d* are an illustration of such receiving means. While these features are not illustrated in FIG. 2, their omission is only for drawing clarity. Further, the apertures do not extend through panel portion 26 so portion 26 must have a thickness suitable to permit the various accessories to be inserted into their corresponding aperture and therein retained. Any additional thickness required to portion 26 will not sufficiently decrease the capacity size of compartment 22 and the providing of the bracket and apertures which are illustrated is intended for those items which are frequently used during a game of golf for which the golfer does not want to search through compartments or pouches.

Figure 4:
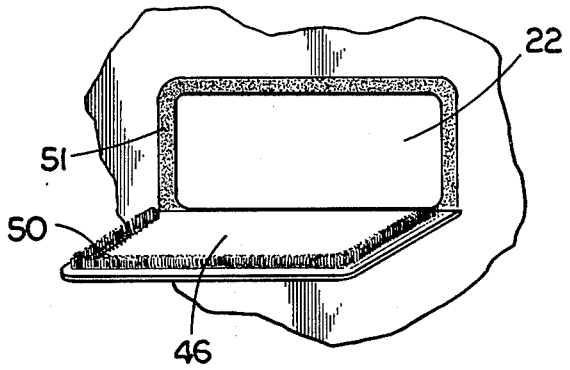
FIG. 4 is a perspective view of a compartment and cover comprising a portion of the FIG. 1 golf club carrier.
Figure 5:
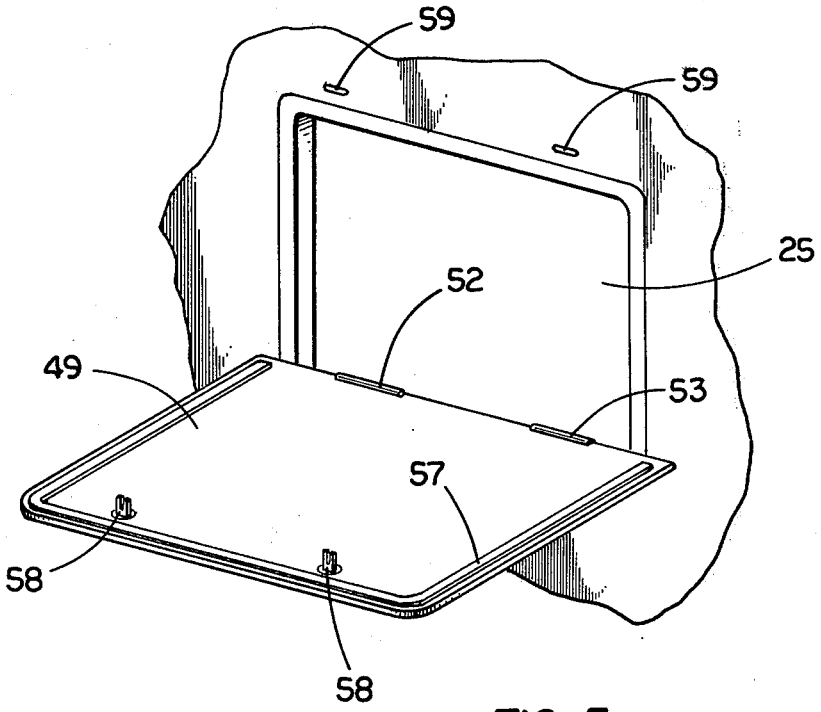
FIG. 5 is a perspective view of a compartment and cover comprising a portion of the FIG. 1 golf club carrier.

As illustrated, there are a total of four discrete, separate compartments arranged for convenient and easily accessible storage of miscellaneous equipment and golf accessories. Each compartment has its own cover panel or access door 46, 47, 48 and 49 (see FIG. 1). These doors may be secured in place over the corresponding compartment openings by such conventional means as snaps, zippers, quarter-turn fasteners, engaging door-edge closures, and the aforementioned "Velcro" fasteners. FIGS. 4 and 5 illustrate the use of synthetic, mutually-engagable hooks and loops (Velcro) and quarter-turn fasteners, respectively. The decision as to what type of securing means to use is governed by the size of the opening to be covered and the potential stress placed on the door from within due to the size and weight of the objects within the compartment. Smaller compartments such as 22 and 23 will normally hold smaller objects such as glasses, balls, tees, pencils, and ball markers, and "Velcro" fasteners or zippers are most convenient for these types of storage compartments. Compartment 22 (see FIG. 4) is closed by door 46 by means of two engaging synthetic strips, one of hook-like projections 50 around the perimeter of door 46 and one of loop-like projections 51 around the perimeter of the opening of compartment 42. Larger compartments such as 24, which are side edge hinged and open outwardly from a vertical centerline, are most conveniently secured by engaging closures disposed on the centerline edges of the door. Quarter-turn fasteners of the pawl type are also suitable for the type of access door illustrated for compartment 24. Compartment 24 is to be used for larger objects such as jackets, shoes, hats and miscellaneous containers.

Compartment 25 is covered by door 49 and is hinged along its lower edge by two interior hinges 52 and 53. Compartment 25 provides an additional, very unique feature; that being the fact that the compartment is lined with a layer of foam insulation 54 (see FIG. 2). This foam liner serves as a thermal insulator such that drinks and food can be stored in compartment 25 for several hours and be maintained near their entering temperature level, whether hot or cold. To complement this foam liner, door 49 is lined with foam and includes a flexible, synthetic gasket 57 which is force-fit against the outer perimeter surface of the compartment opening. This force-fit achieves a virtually air-tight seal and aids in insulating the compartment contents. In order to maintain this force-fit, two spring-biased quarter-turn fasteners 58 are assembled as part of door 49 and matching receptacles 59 for these fasteners are located in the inner member above the compartment opening. A drain aperture 60 is disposed in the base of compartment 25 and is capped with a removable plug on the outside surface.

Although the inner member may be fabricated of any durable material by machining, molding or casting techniques, the preferred construction is to use a synthetic material such as polyethylene or plastic reinforced with glass fibers. A synthetic material permits greater versatility for fabrication techniques and represents a lighter weight object than allowed by the use of most metals. The full section view of FIG. 2 suggests one possible parting line if inner member 21 is molded (or machined) into two halves. These halves are then joined by conventional means such as engaging holes and projecting tabs in combination with an adhesive or cement. By molding or casting inner member 21, each compartment is effectively sealed at all points except the openings. By not having seams around the top and bottom surfaces of each compartment and the surrounding side walls, there is little chance that small particles of dirt, grass and similar debris can accumulate and the compartments are easily cleaned.

Alternative construction concepts are envisioned such as fabricating the inner member from a plurality of discrete piece parts. For example, by beginning with a thick-walled cylindrical tube and then cutting a flat side along a chord, the general exterior shape of inner member 21 can be achieved. Thereafter, top and bottom plates can be attached and separate shelves inserted and secured in place so as to define a plurality of separate compartments. The shortcomings of this type of construction technique are that additional piece parts are required and additional assembly time is necessary. Both of these factors contribute to added cost and are believed to represent an inferior product from the standpoint of durability.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A golf club carrier comprising:

an elongate inner member arranged into a plurality of rigid, separate compartments, wherein said elongate inner member has at least one substantially flat surface, said plurality of rigid, separate compartments being disposed in said one substantially flat surface; and golf club-receiving means disposed around and exterior to said elongate inner member for holding golf clubs in an accessible manner, said golf club-receiving means including an upper lip portion outwardly extending from the exterior of said elongated inner member and a lower shelf portion, said upper lip portion including a spaced plurality of club shaft-receiving apertures.

2. A golf club carrier comprising:

an elongate inner member arranged into a plurality of rigid, separate compartments, said elongate inner member is part-cylindrical having a first curved surface and an enclosing, substantially flat second surface, said plurality of compartments being sequentially arranged in a stacked configuration and provided with separate openings, said openings located in said second surface; and golf club-receiving means disposed around and exterior to said elongate inner member for holding golf clubs in an accessible manner.

3. The golf club carrier of claim 2 wherein each compartment opening is fitted with a separate access panel and at least one compartment is thermally insulated.

4. A golf club carrier comprising:

an elongate inner member arranged into a plurality of rigid, separate compartments, wherein said elongate inner member has at least one substantially flat surface, said plurality of rigid, separate compartments being disposed in said one substantially flat surface;

golf club-receiving means disposed around and exterior to said elongate inner member for holding golf clubs in an accessible manner; and said elongate inner member is part-cylindrical having a first curved surface enclosed by said one substantially flat surface, and said receiving means includes an upper lip portion outwardly extending and disposed around said first curved surface.

5. The golf club carrier of claim 4 wherein said upper lip portion includes a spaced plurality of club shaft-receiving apertures and said receiving means further includes a lower shelf portion outwardly extending around said first curved surface and aligned with said upper lip portion.

6. The golf club carrier of claim 5 which further includes a protective cover secured between said upper lip portion and said lower shelf portion.

* * * * *